US012366147B2

(12) United States Patent
Balasubramanian et al.

(10) Patent No.: US 12,366,147 B2
(45) Date of Patent: Jul. 22, 2025

(54) ELECTRICAL GAS LIFT VALVES AND ASSEMBLIES

(71) Applicant: Schlumberger Technology Corporation, Sugar Land, TX (US)

(72) Inventors: Ganesh Balasubramanian, Sugar Land, TX (US); Oguzhan Guven, Bellaire, TX (US); Jason Bigelow, St. John'S (CA); Naomi Crawford, Houston, TX (US); Yann Dufour, Houston, TX (US); Maria Tafur, Houston, TX (US); Robert Krush, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/264,615

(22) PCT Filed: Feb. 9, 2022

(86) PCT No.: PCT/US2022/015799

§ 371 (c)(1),
(2) Date: Aug. 8, 2023

(87) PCT Pub. No.: WO2022/173815

PCT Pub. Date: Aug. 18, 2022

(65) Prior Publication Data

US 2024/0052730 A1 Feb. 15, 2024

Related U.S. Application Data

(60) Provisional application No. 63/147,652, filed on Feb. 9, 2021.

(51) Int. Cl.
*E21B 43/12* (2006.01)

(52) U.S. Cl.
CPC ..... *E21B 43/1235* (2020.05)

(58) Field of Classification Search
CPC ... E21B 43/123; E21B 43/1235; E21B 34/066
See application file for complete search history.

(56) References Cited

U.S. PATENT DOCUMENTS

| | | | | |
|---|---|---|---|---|
| 4,110,057 | A | 8/1978 | McMurry | |
| 5,176,164 | A * | 1/1993 | Boyle | E21B 43/1235 137/155 |
| 5,743,717 | A | 4/1998 | Schmidt | |
| 5,937,945 | A | 8/1999 | Bussear | |
| 5,971,004 | A | 10/1999 | Pringle | |

(Continued)

FOREIGN PATENT DOCUMENTS

| | | |
|---|---|---|
| BR | 112012013439 A2 | 7/2018 |
| CN | 209278563 | 8/2019 |

(Continued)

OTHER PUBLICATIONS

International Search Report and Written Opinion of PCT Application No. PCT/US2022/015799 dated May 26, 2022, 12 pages.

(Continued)

*Primary Examiner* — Robert E Fuller
(74) *Attorney, Agent, or Firm* — Jeffrey D. Frantz

(57) ABSTRACT

Electrical gas lift valves and systems including electrical gas lift valves are provided.

15 Claims, 13 Drawing Sheets

(56) References Cited

U.S. PATENT DOCUMENTS

| | | | |
|---|---|---|---|
| 6,070,608 | A | 6/2000 | Pringle |
| 6,148,843 | A | 11/2000 | Pringle |
| 6,231,312 | B1 | 5/2001 | Pringle |
| 6,464,004 | B1 | 10/2002 | Crawford |
| 6,852,035 | B2 | 2/2005 | Tsugane |
| 6,873,267 | B1 | 3/2005 | Tubel et al. |
| 7,021,388 | B2 | 4/2006 | Williams |
| 7,259,688 | B2 | 8/2007 | Hirsch |
| 9,670,739 | B2 | 6/2017 | Tosi |
| 9,863,222 | B2 | 1/2018 | Morrow |
| 9,874,091 | B2 | 1/2018 | Thompson |
| 10,273,801 | B2 | 4/2019 | Shah |
| 10,655,439 | B2 | 5/2020 | Murdoch |
| 10,697,278 | B2 | 6/2020 | Elmer |
| 11,035,201 | B2 | 6/2021 | Frazier |
| 2002/0029883 | A1 | 3/2002 | Vinegar et al. |
| 2004/0100037 | A1 | 5/2004 | Ruebsamen |
| 2011/0186303 | A1 | 8/2011 | Scott |
| 2014/0264121 | A1 | 9/2014 | Jackson |
| 2016/0041132 | A1 | 2/2016 | Romer |
| 2016/0290099 | A1 | 10/2016 | Balasubramanian |
| 2018/0149002 | A1 | 5/2018 | Murdoch |
| 2019/0360299 | A1 | 11/2019 | McAdam |
| 2020/0063525 | A1 | 2/2020 | Frazier |
| 2021/0140288 | A1* | 5/2021 | Lisk ..... E21B 34/16 |
| 2021/0172300 | A1* | 6/2021 | Rodger ..... E21B 34/066 |
| 2021/0293123 | A1 | 9/2021 | Watson |

FOREIGN PATENT DOCUMENTS

| | | | |
|---|---|---|---|
| EP | 0745176 | B1 | 4/1996 |
| EP | 1274992 | B1 | 1/2003 |
| EP | 1279795 | B1 | 1/2003 |
| EP | 1686235 | B1 | 8/2006 |
| EP | 2666957 | A2 | 11/2013 |
| EP | 3362641 | B1 | 8/2018 |
| JP | H08219302 | A | 8/1996 |
| WO | 2011102732 | A2 | 8/2011 |
| WO | 2020223437 | A1 | 11/2020 |
| WO | 2021072525 | A1 | 4/2021 |

OTHER PUBLICATIONS

International Search Report and Written Opinion of the PCT Application No. PCT/US2024/10506 dated May 1, 2024, 10 pages.
International Search Report and Written Opinion of the PCT Application No. PCT/US2024/010516 dated May 2, 2024, 13 pages.

* cited by examiner

ELECTRICAL GAS LIFT VALVES AND ASSEMBLIES

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a National Stage Entry of International Application No. PCT/US2022/015799, filed Feb. 9, 2022, which claims priority benefit of U.S. Provisional Application No. 63/147,652, filed Feb. 9, 2021, the entirety of which is incorporated by reference herein and should be considered part of this specification.

BACKGROUND

Field

The present disclosure generally relates to gas lift, and more particularly to electrical gas lift valves and assemblies.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface.

SUMMARY

The present disclosure provides various electrical gas lift valves and various electrical gas lift valve assemblies that can include an electrical gas lift valve and an actuator. Electrical gas lift valves according to the present disclosure include variable orifices that advantageously allow for variable injection gas flow rates. The orifice opening of the valve can be controlled from the surface.

In some configurations, an electrical gas lift valve assembly includes an electrical gas lift valve and an actuator assembly. The electrical gas lift valve includes one or more inlet holes; one or more outlet holes; an orifice positioned along a flow path through the valve such that in use injection gas flows through the inlet holes, through the orifice, and through the outlet holes; and a valve needle configured to move relative to the orifice to selectively increase or decrease a flow area through the orifice. The actuator assembly is configured to cause selective movement of the valve needle relative to the orifice.

The electrical gas lift valve can further include a screw shaft operably coupled to the actuator assembly such that the actuator assembly causes rotation of the screw shaft. The valve can further include a ball screw coupled to the screw shaft and the valve needle, the ball screw configured to convert rotation of the screw shaft into axial translation of the valve needle relative to the orifice. The assembly can include a mandrel housing the electrical gas lift valve. The mandrel can be a single pocket mandrel, with the valve disposed in the pocket and the actuator assembly disposed outside of the mandrel. The mandrel can be a single pocket mandrel, with the valve and actuator assembly co-located in the single pocket. The mandrel can be a dual pocket mandrel, with the valve disposed in one pocket and the actuator assembly disposed in the other pocket. The assembly can further include a control line extending from the surface to the actuator assembly to provide power and/or signals from the surface to the actuator assembly. The control line can be coupled to the actuator assembly via an electrical wet mate connection or an inductive coupler.

In some configurations, an electrical gas lift valve includes a variable orifice opening and is configured to allow for injection port choking over a range of port sizes to allow for adjusting of a flow rate of injection gas. The valve can further include an actuator configured to adjust a size of the variable orifice opening.

In some configurations, a method of operating a gas lift valve includes providing control signals from the surface along a control line extending downhole to an actuator assembly; actuating the actuator assembly to cause rotation of a screw shaft of the gas lift valve; converting rotation of the screw shaft into axial translation of a valve needle of the gas lift valve; and axially translating the valve needle to selectively increase or decrease a flow area through an orifice of the gas lift valve.

The control signals can be provided to the actuator assembly via an electrical wet mate connection of an inductive coupler.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
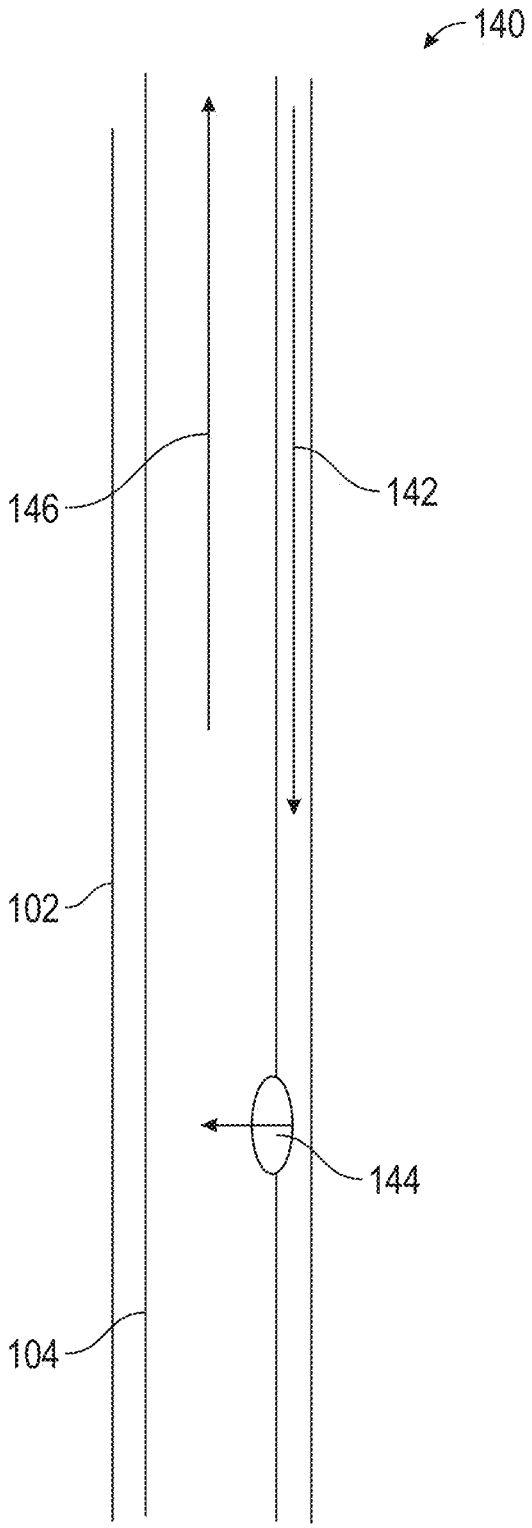
FIG. 1 illustrates a portion of an example of a gas lift system.

FIG. 1 illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146.

Figure 2:
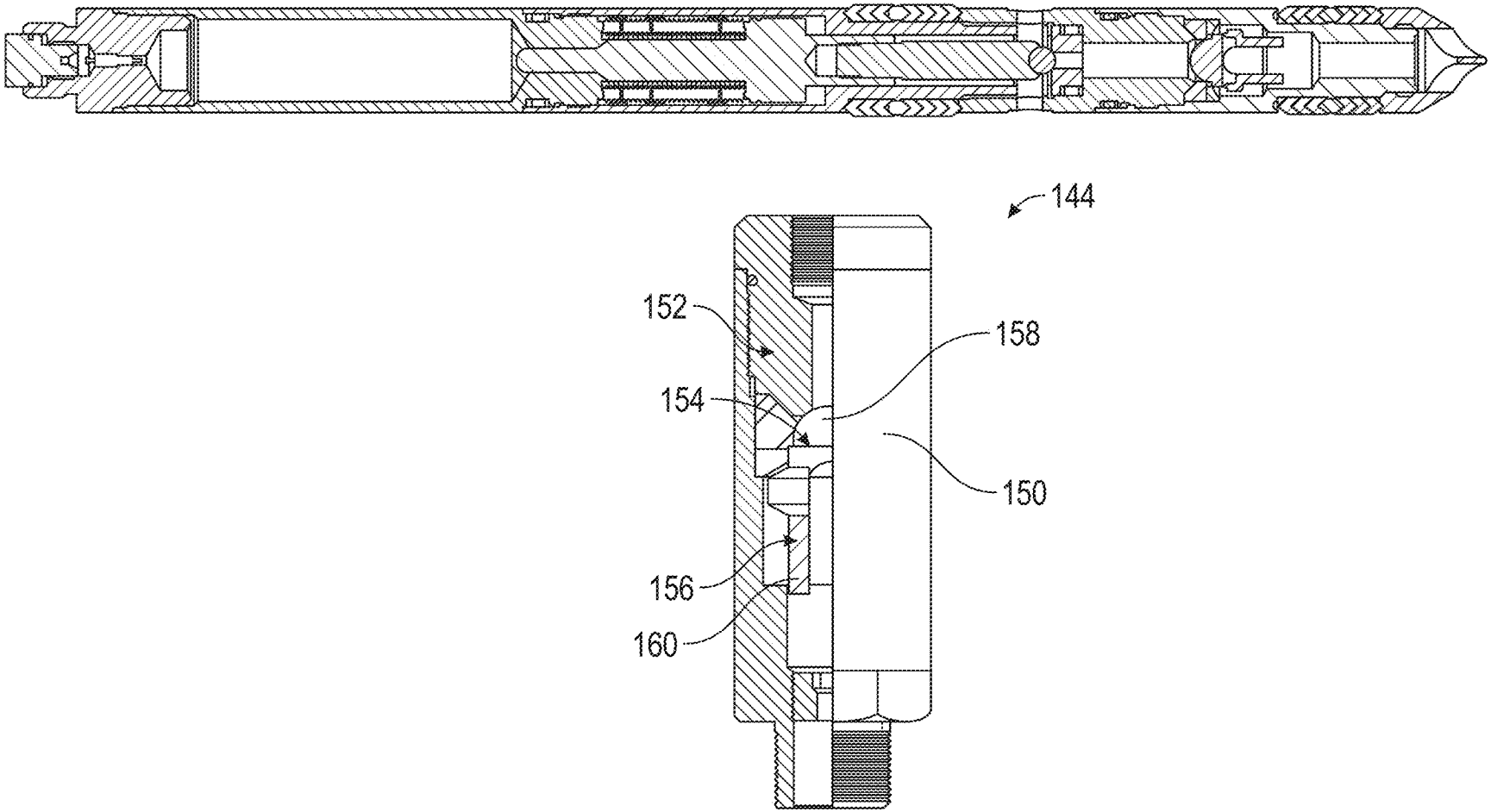
FIG. 2 (PRIOR ART)
FIG. 2 illustrates example existing gas lift valves.

FIG. 2 illustrates examples of currently available valves 144 that may be used in a gas lift system 140. As shown, the valve 144 includes a check bushing 152, a check dart 154, and a spring (positioned at location 156) disposed in an outer housing 150. The check dart 154 has a hemispherical head 158 and a stem 160 extending away from the head 158. The spring can be disposed about the stem 160. In a closed position, the hemispherical head 158 of the check dart 154 seals against the check bushing 152. The spring can bias the check dart 154 toward the closed position when no pressure is applied to the valve 144. When pressure is applied, e.g., by gas flow along direction 142, the spring is compressed and the check dart 154 moves away from the check bushing 152, thereby opening the valve 144.

The orifice size of gas lift valve(s) 144 limits the gas injection rate. For traditional operating valves, orifice size is fixed during installation and cannot be changed during operation. To change the orifice size, the operating valve must be replaced through intervention. Interventions for changing of the valve(s) 144 could be needed for numerous reasons. For example, dummy valves may be used for pressure testing of the annulus, then switched to live valves. In use, if there is a change in reservoir pressure or choking wellhead due to sand control, this could change the location of the injection point in the completion string. In the case of restricted production, for example from water injection pressure support where production is reduced below the design port size, a valve change may be required for optimization. Water cut increases cause a larger port size to be needed to unload the well or initiate gas lift after a shut in. If interventions are not performed when needed, for example in the situations described above, the well may not be optimized, leading to lower production or reduced gas allocation optimization.

Traditional gas lift valves do not allow for throttling or choking of gas flow at the valve. In conventional wells, change in reservoir inflow performance happens over a period of several years, not requiring any manipulation of orifice size to change gas injection rate. With a traditional production profile, it takes years for the well to decline from plateaued production rates. Therefore, gas lift valve change outs for maintenance or orifice size change can be performed as part of a planned intervention, not incurring additional operational costs. However, with changing reservoir inflow performance and well production profile, such as in unconventional fields or in conventional fields with gas lift optimization programs, this may not be an ideal option. Dynamic manipulation of operating valve orifice size from the surface to improve production rates, without incurring additional intervention costs and while keeping operational costs low, becomes desired.

The present disclosure provides electric gas lift valves, assemblies, and systems. Such electric gas lift valves and assemblies can be controlled from the surface, for example, via an electrical line extending downhole to the valve or assembly. Electric gas lift valves of the present disclosure advantageously include variable orifices that can be adjusted without the need for intervention. The ability to adjust in real time without intervention can allow for significant cost savings, optimized or improved gas injection, maximized or improved production, and/or reduced downtime. The orifice opening can be adjusted and controlled to allow for manipulation of the gas injection rate to thereby adjust for changing reservoir inflow performance and increase the production rate as desired or required.

Electrical gas lift valves and systems can be particularly desirable as the completions industry is moving towards digital technologies to help operators function wells more efficiently. High tier markets with moderate to high production rates cannot afford down time and look to optimize production throughout the life of the well or project. Reducing the down time between planned or unplanned shut downs can create greater uplift. Electrical gas lift systems can advantageously provide many benefits, including: intervention time and/or cost savings, optimized gas injection for optimized production, minimized or reduced down time for shut-ins with automated start up, optimized field production with gas allocations, accurate gas injection measurements, enhanced troubleshooting methods, enhanced barrier testing thereby reducing down time, and/or reducing $CO_2$ footprint.

Figure 4:
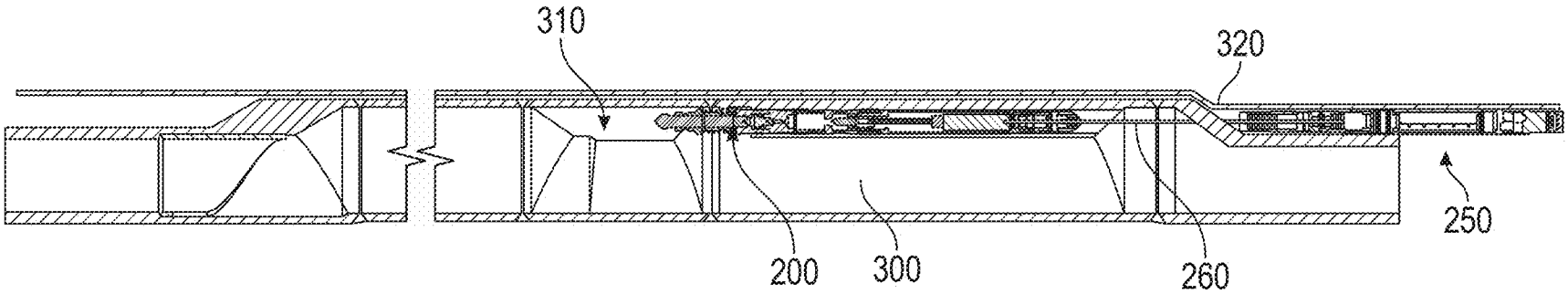
FIGS. 4-6 illustrate example electrical gas lift valve assemblies.
Figure 5:
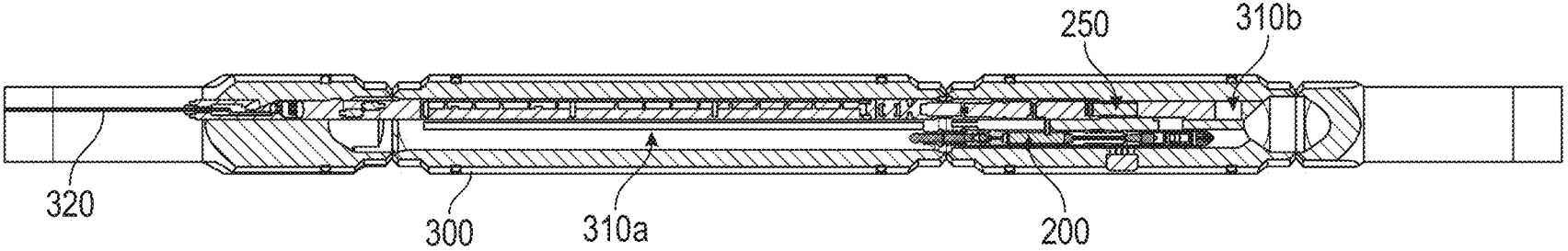
Figure 6:
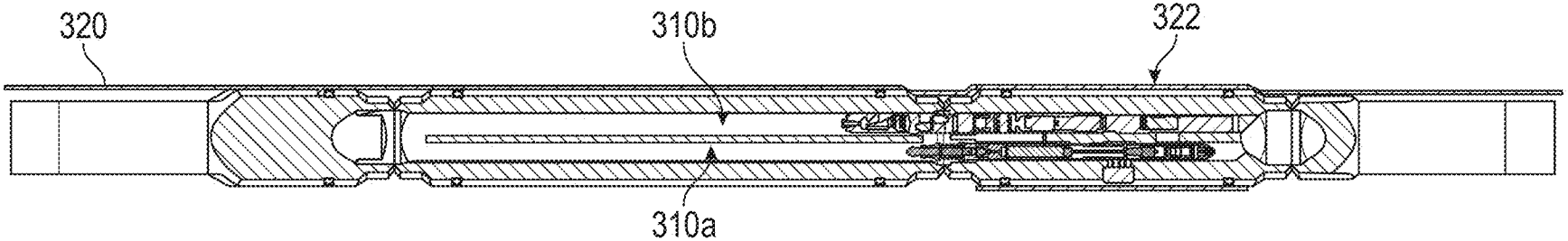

FIGS. 3A-3D illustrate various example configurations for an electrical gas lift valve 200 according to the present disclosure. These configurations allow for injection port choking over a range of port sizes to allow for adjustment of injection gas flow rate. Electrical gas lift assemblies according to the present disclosure can include an electrical gas lift valve 200 and an electromechanical actuator unit or assembly 250. FIGS. 4-6 illustrate example electrical gas lift assemblies, for example, that can include a gas lift valve 200 configuration as shown in FIGS. 3A-3D. FIGS. 7-14 illustrate additional details of various example electrical gas lift valves 200 and/or assemblies. An electrical gas lift valve assembly according to the present disclosure can also include a mandrel 300 that houses the electrical gas lift valve 200 and/or the actuator assembly 250.

The actuator assembly 250 can be located within or outside of the mandrel 300. The mandrel 300 can include a single pocket 310 or dual pockets 310*a*, 310*b*. In a single pocket 310 mandrel 300, the gas lift valve 200 is disposed in the pocket 310. The actuator assembly 250 can be disposed in the pocket 310 with the gas lift valve 200, or disposed outside of the mandrel 300. In a dual pocket mandrel 300, the gas lift valve 200 can be disposed in one pocket 310*a*, and the actuator assembly 250 can be disposed in the other pocket 310*b*.

The electromechanical actuator unit 250 can include a motor 254, a step down gear box 256, and electronics 258, which may include a battery pack. The actuator unit 250 allows for injection port choking in the gas lift valve 200 via electrical signals transmitted via a cable 320 running downhole from the surface. The cable 320 can be operably coupled to and provide power and/or signals to the actuator assembly 250, e.g., the motor, via an electrical wet-mate connection or an inductive coupler. An electrical gas lift system according to the present disclosure can include one or more electrical gas lift valve assemblies, including an electric gas lift valve 200, an actuator assembly 250, and/or a mandrel 300, a power cable or control line 320, and may include a compressor located at the surface as well as various tubings, controllers, and/or other components. Electrical gas lift valves 200, electrical gas lift valve assemblies, and/or electrical gas lift systems according to the present disclosure can include various features of the configurations shown in the figures and described herein in various combinations and sub-combinations.

Figure 3A:
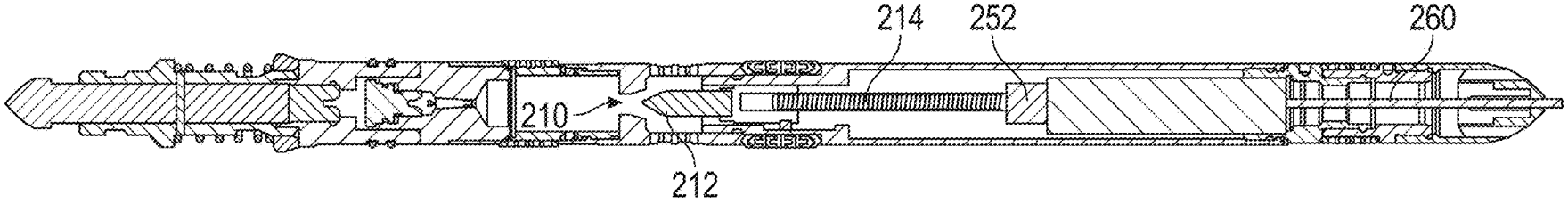
FIGS. 3A-3D illustrate various example electrical gas lift valves.
Figure 3B:
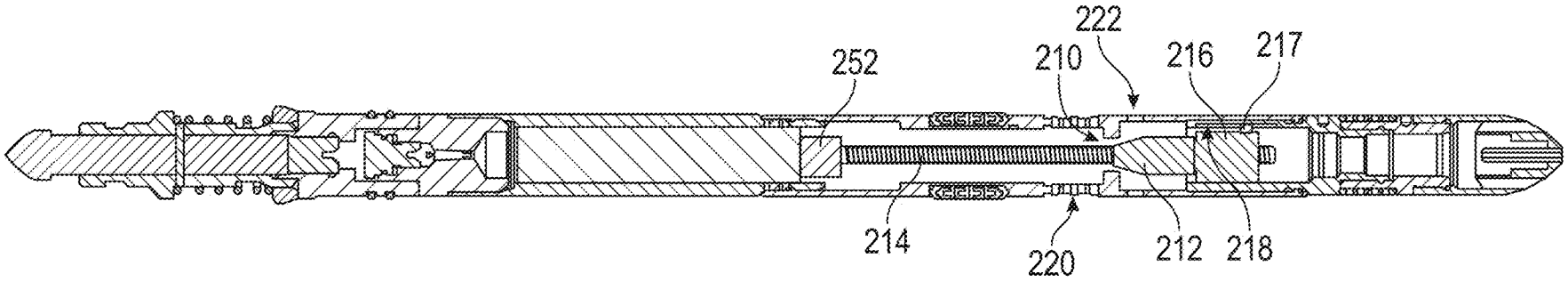
Figure 3C:
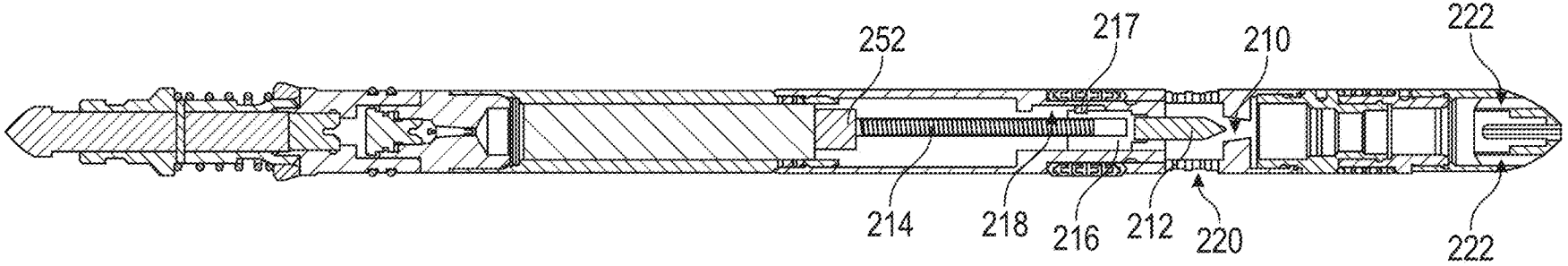

As shown in FIGS. 3A-3C, some electric gas lift valves 200 according to the present disclosure include an orifice 210, a valve needle 212, a screw shaft 214, and a ball screw 216 or nut/block. In use, injection gas flows into the valve 200 through one or more inlets 220, through the orifice 210, and out of the valve 200 through one or more outlets 222 to then enter the production tubing. A greater orifice opening area allows a greater flow of injection gas through the valve 200 and into the production tubing. In the configuration of FIG. 3C, the outlets 222 are located at a bottom or downhole end of the valve 200. In the configuration of FIG. 3B, the outlets 222 are located along a side wall of the valve axially spaced from the bottom or downhole end.

The screw shaft 214 is operably coupled to the actuator assembly 250. In some configurations, the screw shaft 214 is coupled to a drive shaft 252, which is operably coupled to the actuator assembly 250. When actuated, the actuator assembly 250 causes rotation of the screw shaft 214. The ball screw 216 translates or converts rotational motion of the screw shaft 214 to linear motion. As the screw shaft 214 rotates, the ball screw 216 therefore translates axially within the valve. As shown, a portion of the ball screw 216, for example, an anti-rotation screw 217, may translate axially along a track 218 or channel in an inner wall or surface of the valve housing. The track 218 can limit or define the boundaries of the range of axial movement of the ball screw 216.

The valve needle 212 is coupled to the ball screw 216 such that the valve needle 212 translates axially with the ball screw 216. Movement of the valve needle 212 toward and away from the orifice 210 reduces and enlarges the orifice 210, respectively. The opening area of the orifice 210 can be calculated by multiplying the number of rotations of the shaft 214 by the screw pitch to determine the axial distance traveled by the valve needle 212. In the configuration of FIG. 3B, uphole or leftward movement of the valve needle 212 reduces the orifice 210 size. In the configuration of FIG. 3C, downhole or rightward movement of the valve needle 212 reduces the orifice 210 size. In the illustrated configurations, the valve needle 212 has a generally truncated conical shape, with the smaller end of the truncated cone facing the orifice 210.

FIG. 4 illustrates an example electrical gas lift valve assembly including a single pocket 310 mandrel 300 housing the eGLV (electric gas lift valve) 200. The actuator assembly 250 is disposed outside the mandrel 300 and is powered by a control line or power cable 320 from the surface. In some configurations, the eGLV 200 can be, be similar to, or include some of the features of the eGLV 200 shown in FIG. 3A. In the illustrated configuration, the actuator assembly 250 is positioned below or downhole of the mandrel pocket 310 and the eGLV 200. A rod, shaft, or cable 260 can extend from the actuator assembly 250 into the pocket 310 and operably couple the actuator assembly 250 to the drive shaft 252 and/or screw shaft 214.

Figure 7:
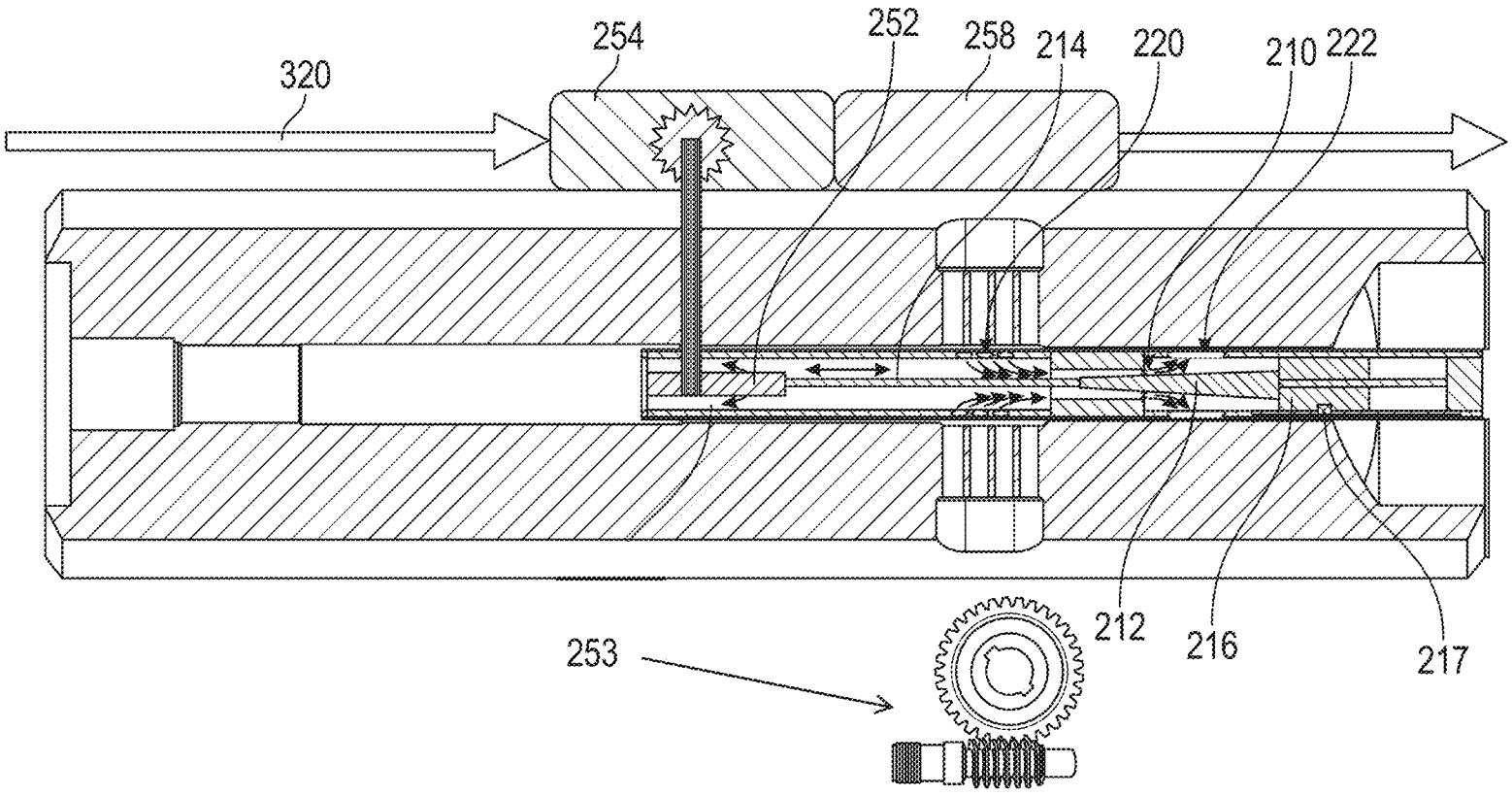
FIGS. 7-11 illustrate additional details of various example electrical gas lift valves and/or assemblies.

FIG. 7 illustrates another example gas lift valve assembly including a single pocket 310 mandrel 300 housing the eGLV 200 with the actuator assembly 250 disposed outside the mandrel 300. The eGLV 200 can be, be similar to, or include some of the features of the eGLV 200 shown in FIG. 3B. In the configuration of FIG. 7, the actuator assembly 250 is positioned generally radially aligned with or parallel to the valve 200. As shown, the actuator assembly 250, e.g., the motor 254, can be coupled to the valve 200, e.g., the drive shaft 252, via one or more worm gear assemblies 253. Other coupling mechanisms are also possible. The cable 320 can be coupled to the actuator assembly 250 via an electrical wet mate connection. The configuration of FIG. 7 may allow for minimal change with no or minimal additional complexity in mandrel manufacturing compared to existing gas lift valve mandrels. In some configurations, the eGLV 200 is non-retrievable. In other words, the eGLV 200 of FIG. 7 may not be retrievable from the mandrel 300, for example, via wireline or other methods, while the mandrel 300 remains in hole.

Figure 8A:
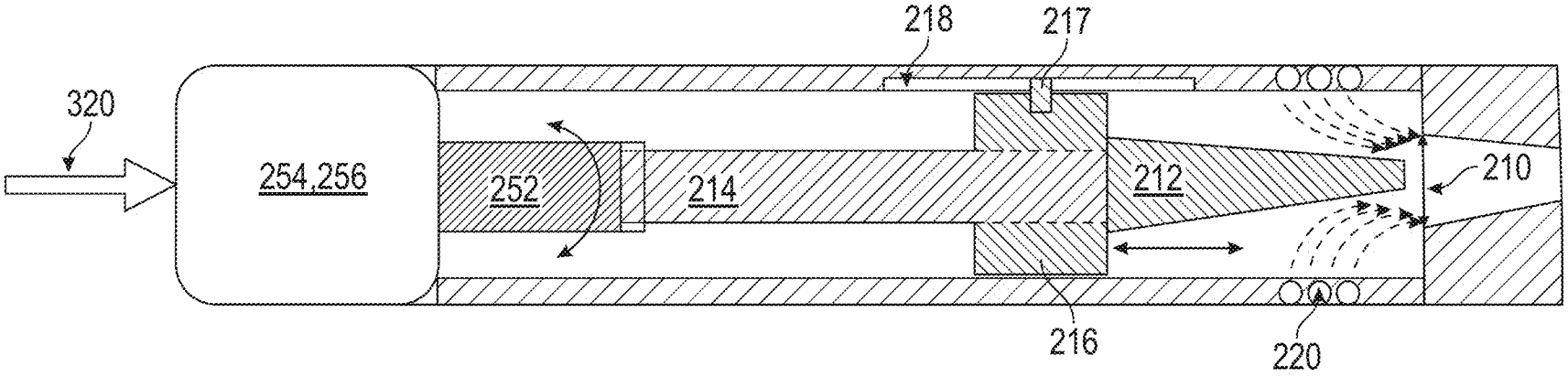
Figure 8B:
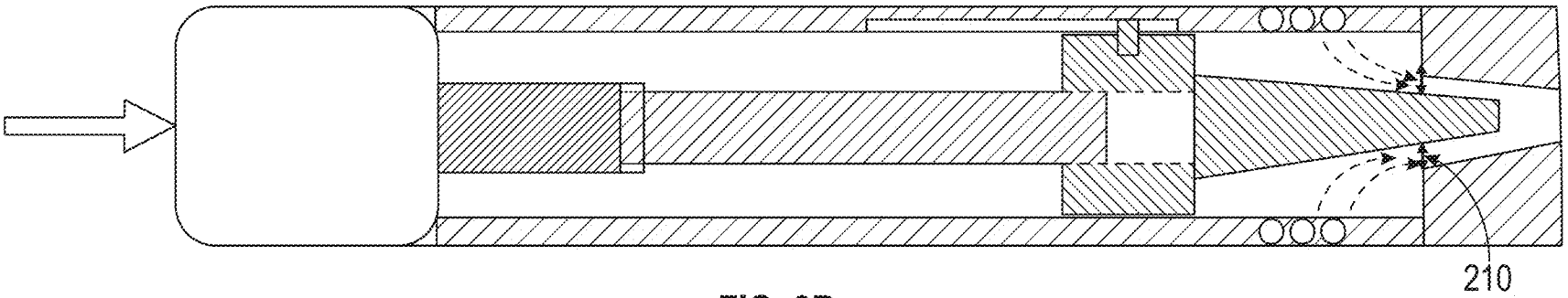
Figure 9A:
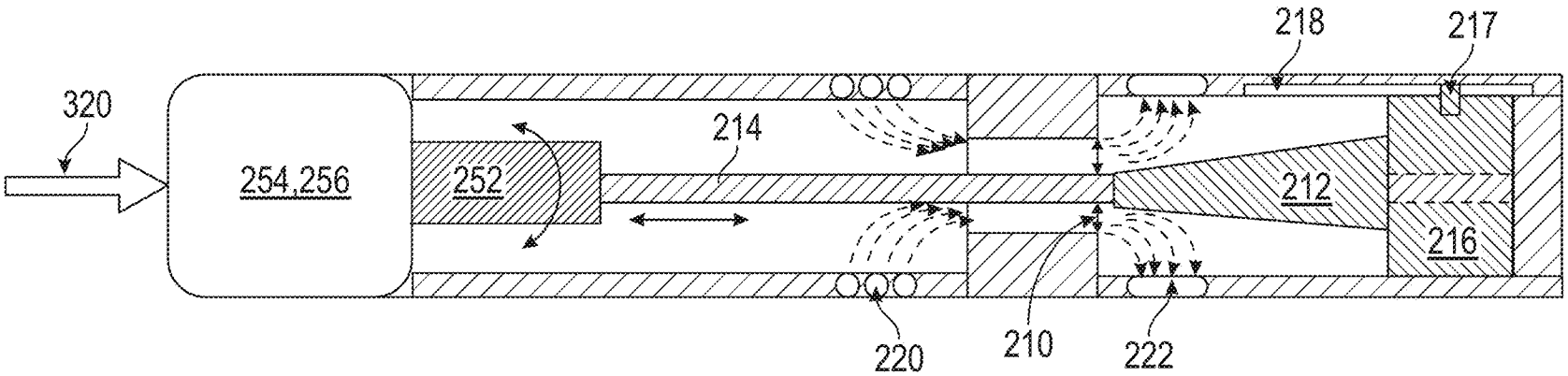
Figure 9B:
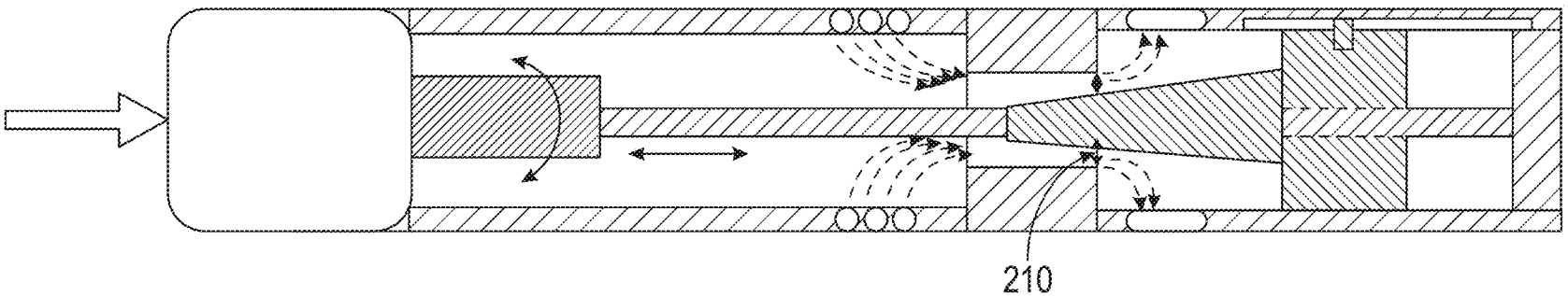
Figure 10A:
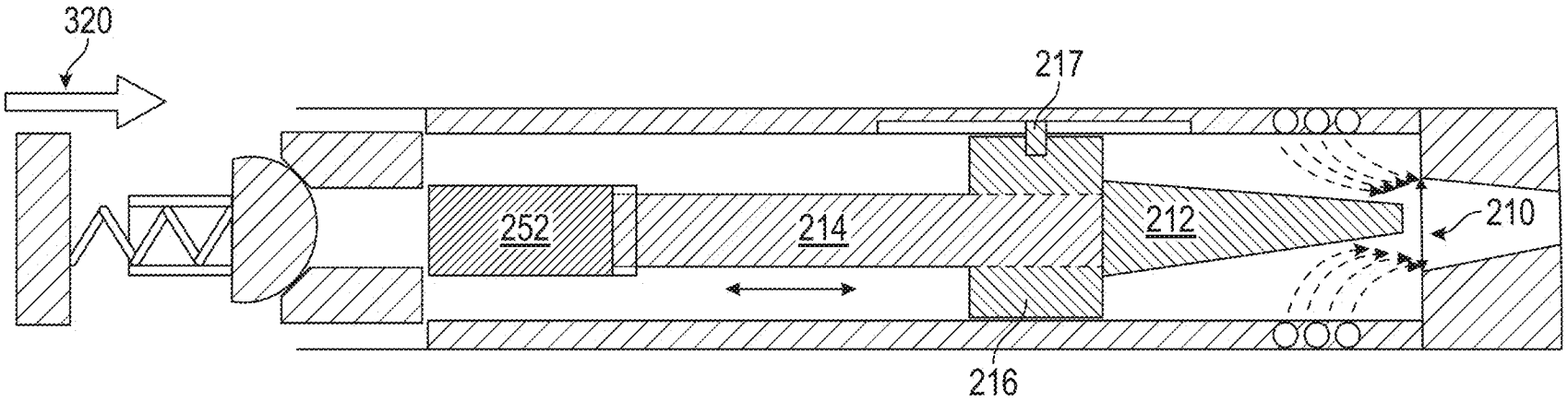
Figure 10B:
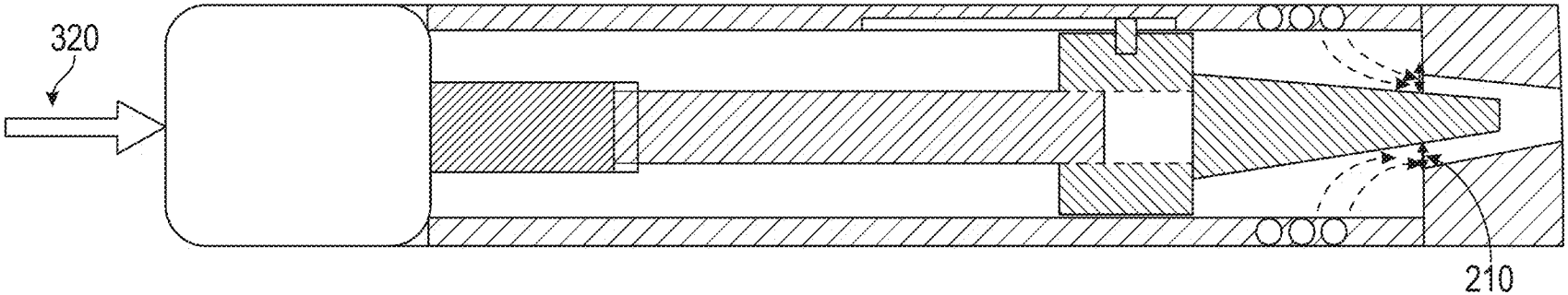
Figure 11:
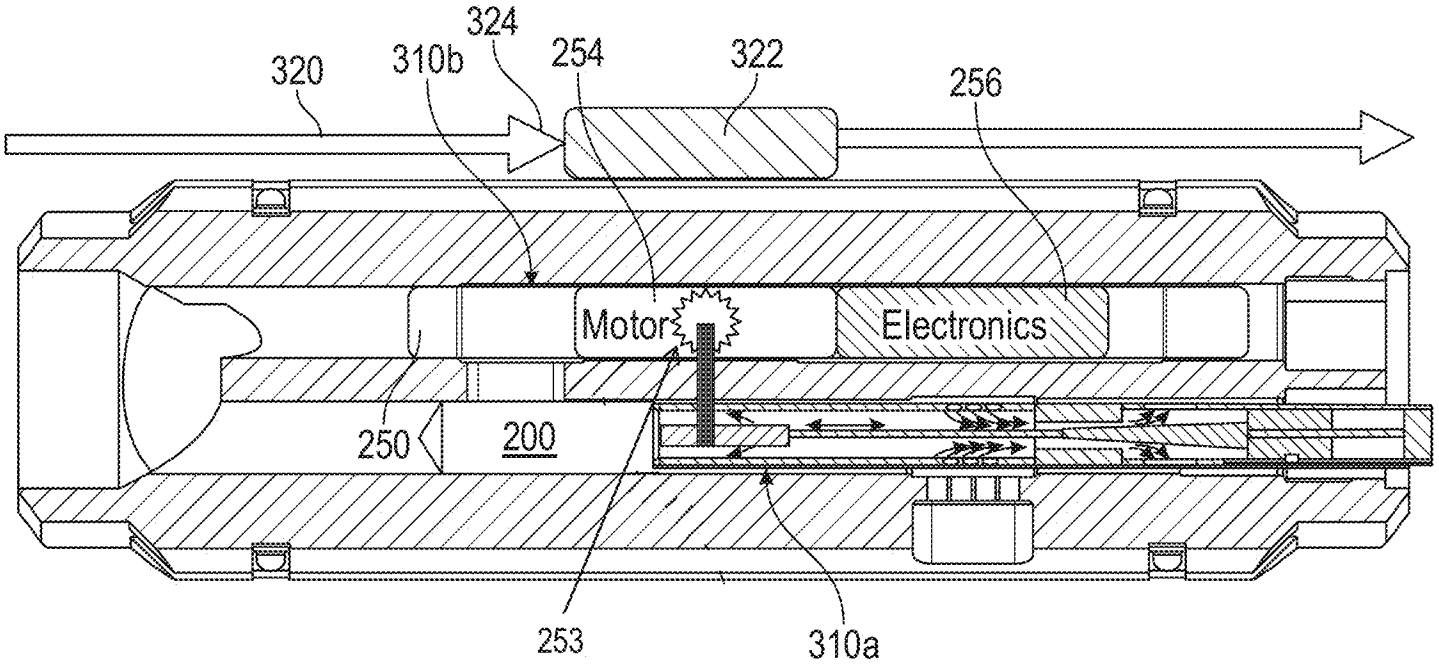

FIGS. 8-10 illustrate example gas lift valve assemblies in which the actuator 250 is combined with the valve 200 in the same assembly. In other words, the actuator assembly 250 can be co-located with the valve 200 in one mandrel 300 pocket 310. The actuator assembly 250 can be physically coupled to and/or combined with the valve 200 in a common housing. The combined actuator and valve assembly may be longer than a typical valve or an eGLV 200 with the actuator 250 disposed outside the pocket 310 in which the valve 200 is located. FIG. 8A shows the valve in a relatively more open position, with a greater orifice opening area, compared to FIG. 8B. Similarly, FIG. 9A shows the valve in a relatively more open position, with a greater orifice opening area, compared to FIG. 9B. The eGLV 200 of FIGS. 8A-8B can be, be similar to, or include some of the features of the eGLV 200 shown in FIG. 3C. The eGLV 200 of FIGS. 9A-9B can be, be similar to, or include some of the features of the eGLV 200 shown in FIG. 3B. The cable 320 can be coupled to the actuator assembly 250 via an electrical wet mate connection 324 (for example as schematically illustrated in FIG. 11) and/or an inductive coupler 322 (for example as schematically illustrated in FIG. 11). In some configurations, an inductive coupling may allow the valve 200 to be retrievable. In some configurations, a valve 200 in which the electrical line 320 is coupled via a wet-mate connector may not be retrievable.

FIGS. 5 and 6 illustrate example electrical gas lift valve assemblies including a dual pocket mandrel 300 with an eGLV 200 in one pocket 310*a* and the actuator assembly 250 in the other pocket 310*b*. In the configuration of FIG. 5, the cable 320 can be coupled to the actuator assembly 250 via a wet mate connection. In the configuration of FIG. 6, the cable 320 can be operably coupled to the actuator assembly 250 via an inductive coupler 322. FIG. 11 illustrates another example electrical gas lift valve assembly including a dual pocket mandrel 300 with the eGLV 200 in one pocket 310*a* and the actuator assembly 250 in the other pocket 310*b*. In the configuration illustrated in FIG. 11, the cable 320 is operably coupled to the actuator assembly 250 via an inductive coupler 322. As shown, the actuator 250, e.g., the motor 254, can be coupled to the valve 200, e.g., the drive shaft 252, via a worm gear assembly 253. Other mechanisms are also possible. In some configurations, the valve 200 may not be retrievable.

Figure 3D:
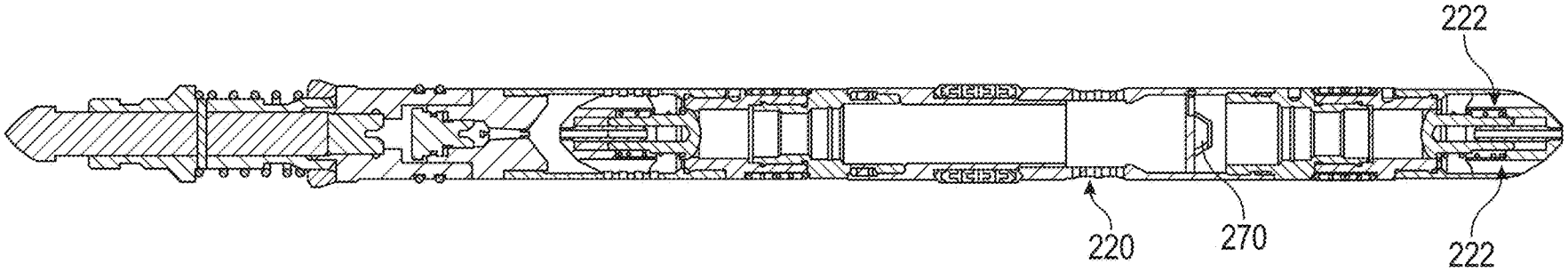
Figure 12:
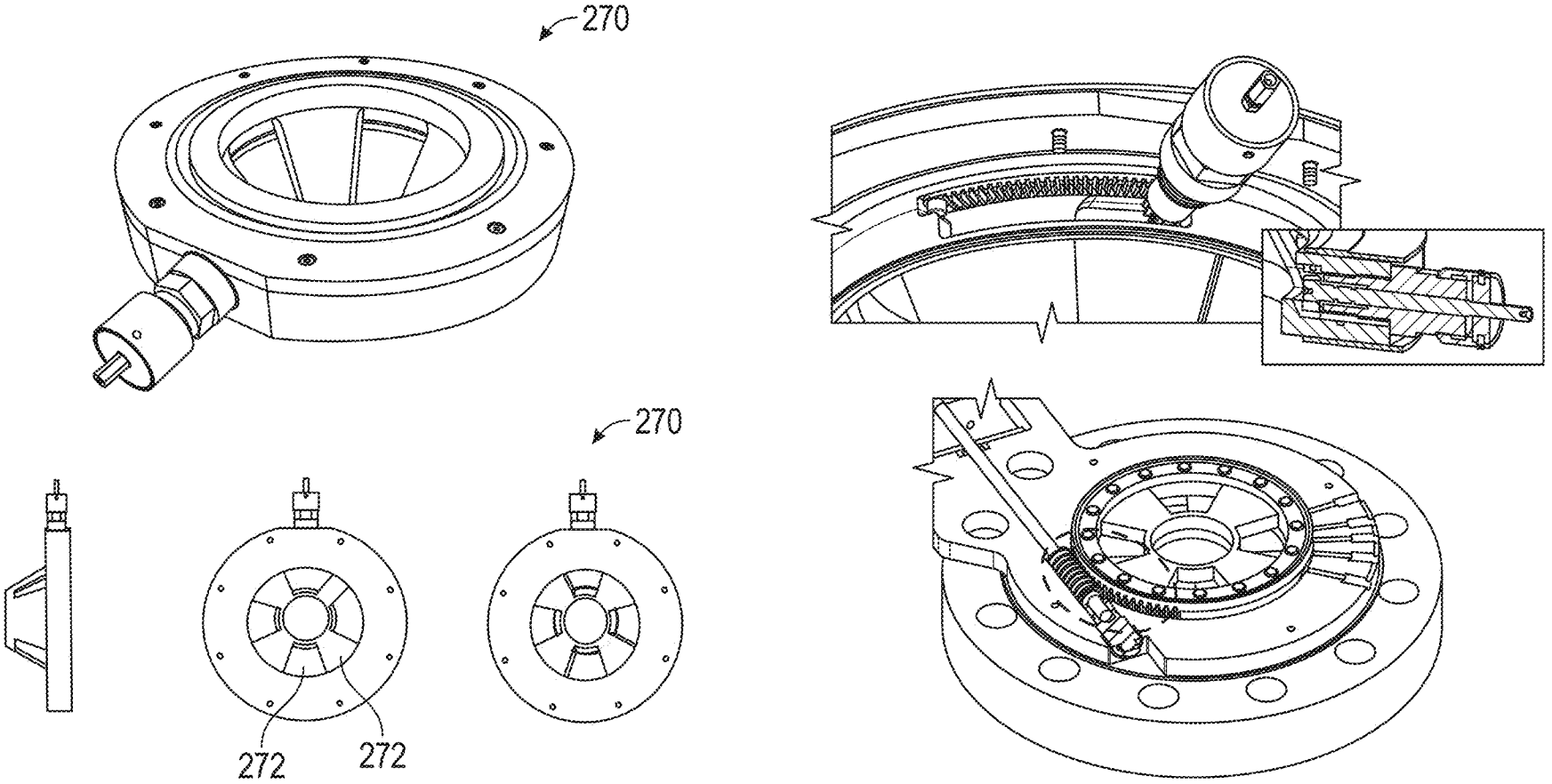
FIG. 12 illustrates an example dynamic variable orifice that can be used in electrical gas lift valves and/or assemblies according to the present disclosure.
Figure 13:
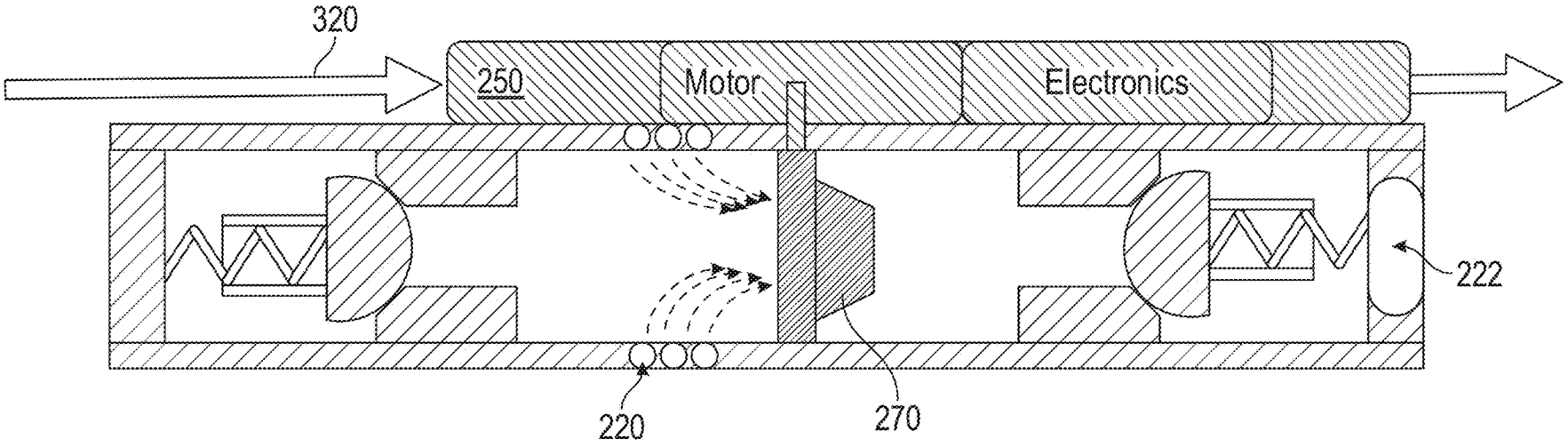
FIG. 13 illustrates an example of an electrical gas lift valve including a scaled down dynamic variable orifice.
Figure 14:
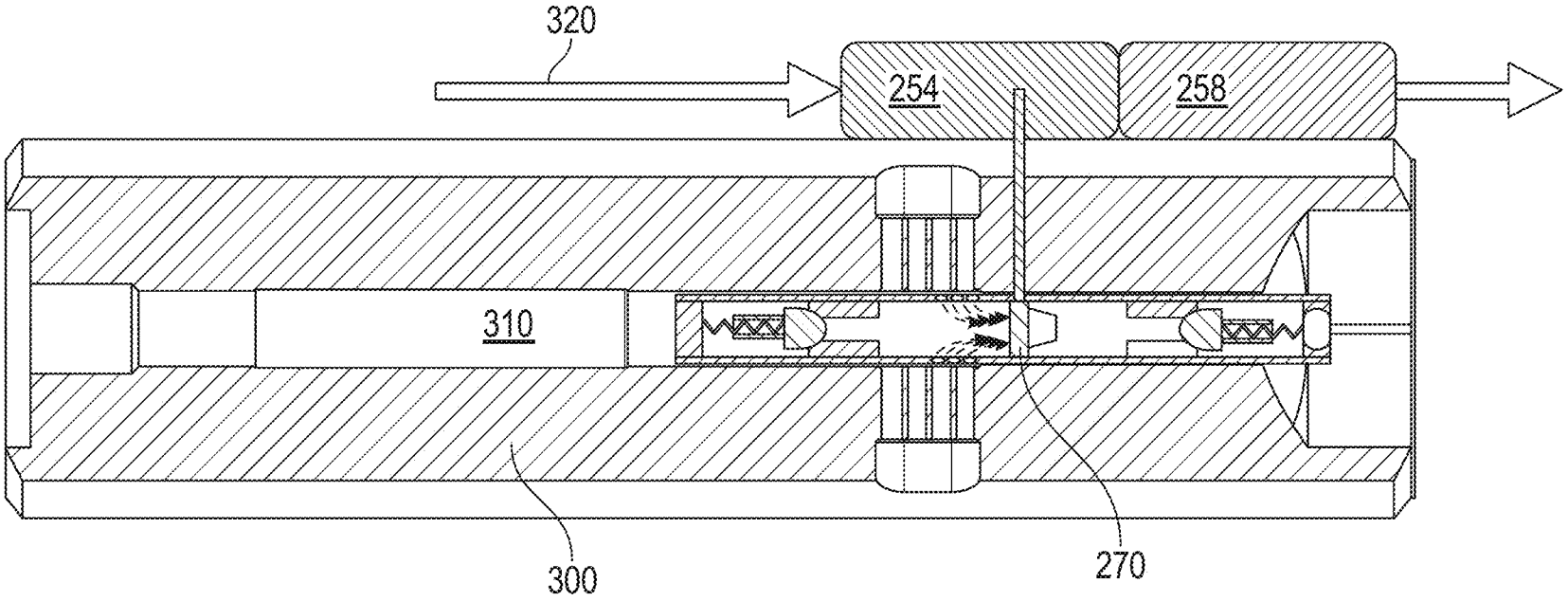
FIG. 14 illustrates an example gas lift valve assembly.

FIG. 12 illustrates an example dynamic variable orifice (DVO) 270 that can be used in electrical gas lift valves 200 and/or assemblies according to the present disclosure. Dynamic variable orifices are available from, for example, ACI Services, Inc. As shown, the DVO can include two windowed plates 272, with one rotatable relative to the other. The rotatable plate rotates relative to the other plate to selectively open or close the windows. The plates can be adjusted to achieve variable flow areas in the spectrum from fully open to fully closed. FIGS. 3D and 13 illustrate an example of an electrical gas lift valve 200 including a scaled down dynamic variable orifice 270, for example a dynamic variable orifice as shown in or similar to as shown in FIG. 12. The DVO 270 forms the orifice of the valve 200. FIG. 14 illustrates an example gas lift valve assembly including the dynamic variable orifice gas lift valve 200 of FIGS. 3D and 13 disposed in a single pocket 310 mandrel 300, with an actuator assembly 250 disposed outside the mandrel 300. The actuator 250, e.g., the motor 254, can be operably coupled to the DVO 270 via a control line or other mechanism. In some configurations, the valve 200 is not retrievable.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electrical gas lift valve assembly comprising:

an electrical gas lift valve comprising:

one or more inlet holes;

one or more outlet holes;

an orifice positioned along a flow path through the valve such that in use injection gas flows through the inlet holes, through the orifice, and through the outlet holes; and a valve needle configured to move relative to the orifice to selectively increase or decrease a flow area through the orifice, the valve needle and the orifice arranged such that injection gas flows through the orifice when the valve needle extends through the orifice; and an actuator assembly configured to cause selective movement of the valve needle relative to the orifice, the actuator assembly including a rotatable screw shaft and a ball screw, the ball screw having an anti-rotation member extending into a track to prevent rotation of the ball screw, the ball screw coupled to the valve needle, and the rotatable screw shaft extending through the orifice.

2. The assembly of claim 1, wherein the actuator assembly is further configured to rotate the rotatable screw shaft.

3. The assembly of claim 2, wherein the ball screw is coupled to the rotatable screw shaft and the valve needle, the ball screw configured to convert rotation of the rotatable screw shaft into axial translation of the valve needle relative to the orifice.

4. The assembly of claim 1, further comprising a mandrel housing the electrical gas lift valve.

5. The assembly of claim 4, wherein the mandrel is a single pocket mandrel, the electrical gas lift valve is disposed in a single pocket, and the actuator assembly is disposed outside of the mandrel.

6. The assembly of claim 4, wherein the mandrel is a single pocket mandrel, and the electrical gas lift valve and actuator assembly are co-located in a single pocket.

7. The assembly of claim 4, wherein the mandrel is a dual pocket mandrel, the electrical gas lift valve is disposed in one pocket, and the actuator assembly is disposed in the other pocket.

8. The assembly of claim 1, further comprising a control line extending from a surface to the actuator assembly to provide power and/or signals from the surface to the actuator assembly.

9. The assembly of claim 8, wherein the control line is coupled to the actuator assembly via an electrical wet mate connection.

10. The assembly of claim 8, wherein the control line is coupled to the actuator assembly via an inductive coupler.

11. The assembly of claim 1, wherein the valve needle is coaxial with the orifice.

12. The assembly of claim 1, wherein the valve needle is a solid structure.

13. A method of operating a gas lift valve, the method comprising:

providing control signals from a surface along a control line extending downhole to an actuator assembly;

actuating the actuator assembly to cause rotation of a screw shaft of the gas lift valve, the actuator assembly including a worm gear that converts rotation of an intermediate shaft into rotation of the screw shaft, the intermediate shaft oriented perpendicular to the screw shaft;

converting rotation of the screw shaft into axial translation of a valve needle of the gas lift valve; and axially translating the valve needle at least partially through an orifice of the gas lift valve to selectively increase or decrease an open flow area through the orifice of the gas lift valve.

14. The method of claim 13, wherein the control signals are provided to the actuator assembly via an electrical wet mate connection.

15. The method of claim 13, wherein the control signals are provided to the actuator assembly via an inductive coupler.

* * * * *